US005944281A

United States Patent [19]

Pittman et al.

[11] Patent Number: 5,944,281

[45] Date of Patent: Aug. 31, 1999

[54] DUAL BAND MILLIMETER-INFRARED FIBER OPTICS GUIDANCE DATA LINK

[75] Inventors: William C. Pittman; James H. Mullins; John B. Meadows, all of Huntsville, Ala.

[73] Assignee: The United States of America as represented by the Secretary of the Army, Washington, D.C.

[21] Appl. No.: 09/036,770

[22] Filed: Mar. 9, 1998

[51] Int. Cl.[6] ..... F41G 7/32

[52] U.S. Cl. ..... 244/3.12

[58] Field of Search ..... 244/3.12, 3.19, 244/3.16, 3.11

[56] References Cited

U.S. PATENT DOCUMENTS

| | | | |
|---|---|---|---|
| Re. 35,553 | 7/1997 | Li | 244/3.12 |
| 5,035,375 | 7/1991 | Friedenthal et al. | 244/3.12 |
| 5,062,586 | 11/1991 | Hobson et al. | 244/3.12 |
| 5,310,134 | 5/1994 | Hsu et al. | 244/3.12 |
| 5,341,435 | 8/1994 | Corbett et al. | 382/1 |
| 5,637,826 | 6/1997 | Bessacini et al. | 114/21.1 |

*Primary Examiner*—Charles T. Jordan
*Assistant Examiner*—Christopher K Montgomery
*Attorney, Agent, or Firm*—Arthur H. Tischer; Hay Kyung Chang

[57] ABSTRACT

The dual band millimeter-infrared fiber optics guidance data link presents enhanced seekers with the capability to see through cloud cover while exhibiting resolution that is adequate to strike high value targets. Such a seeker may use a bi-directional dual band data link in the form of a secure, high bandwidth optical fiber between the missile in flight and the ground station, offering the capability to transmit millimeter-infrared sensor data from the missile to the ground station and transmit missile guidance signals from the ground station to the missile over the same high bandwidth optical fiber. Both infrared and millimeter target signature data is made available in the ground station by the use of applicants' invention. Such availability not only provides the gunner with an additional capability to identify the target and thus avoid fratricide, but fusion of the infrared and millimeter data in the automatic target recognizer in the ground station provides an additional capability to classify and identify targets while preserving high-value components of the data link by their removal from the missile to the ground station.

15 Claims, 7 Drawing Sheets

FIGURE 1 - PRIOR ART

FIGURE 2 - PRIOR ART

FIGURE 3 - PRIOR ART

DUAL BAND MILLIMETER-INFRARED FIBER OPTICS GUIDANCE DATA LINK

DEDICATORY CLAUSE

The invention described herein may be manufactured, used and licensed by or for the Government for governmental purposes without the payment to us of any royalties thereon.

BACKGROUND OF THE INVENTION

The LONGFOG is a long-range fiber optic guided missile currently under research. The LONGFOG, when successful, will be capable of striking targets at ranges of 100 kilometers or more. It will be launched from a modified MLRS (Multiple Launch Rocket System) launcher and be controlled from an advanced ground station compatible with JSTARS (Joint Surveillance Target Attack Radar System). As the missile flies out rapidly to the target area under the control of a GPS (Global Positioning System)-inertial navigation system, scenes from an infrared imaging seeker will be transmitted over a single-mode, high bandwidth fiber to the ground controller. The man-in-the-loop will provide capability for combat identification, and variable-geometry wings and a throttleable propulsion system will allow the missile velocity to be controlled to aid target detection. The addition of a millimeter seeker capability to the missile will allow the missile to fly above or within cloud cover that might impair infrared seeker performance, and if the millimeter seeker is adapted for an altimeter function, then the missile could fly at low altitudes to take advantage of terrain masking, thus allowing great flexibility in the design of the fly-out trajectories. The resolution capability of the millimeter seeker, while poorer than that of the infrared seeker, is expected to be sufficient for attacking high value targets.

A Brief History of FOG-M (Fiber Optic Guided Missile)

FOG-M, a guided missile which uses fiber optics to transmit sensor images to a concealed launcher on the ground, was developed at the U.S. Army's Research, Development, and Engineering Laboratory at Redstone Arsenal. This missile pays out fiber from a spool in the rear of the missile as it flies to its target. The gunner on the ground looks at a television to which the information from the sensor images have been input and picks a target for the missile, locks on and allows the missile to impact upon the target automatically. The two main advantages of the FOG-M system are that the expensive parts of a missile system can be located on the ground and re-used and that the gunner can fire upon armored ground and airborne targets while being totally concealed from the enemy. The gunner can also identify the target accurately as the missile enters the target area and thus avoid fratricide. The low cost FOG-M system can work with many different types of imaging sensors such as TV, low light TV, medium and long wavelength IR (infrared). The constantly declining costs of electro-optic sources, detectors and fiber have allowed the technology of fiber-optic guided missiles to come of age and into the modem battlefield.

The FOG-M program was originally based upon a small six-inch missile which was launched vertically from a HMMWV (High Mobility Multi-purpose Wheeled Vehicle) and had a range greater than 10 km. The missile autopilot, video tracking, correlation navigation and guidance functions were performed by the equipment located on the launcher. The gunner's station, also at the launcher, performed inertial land navigation, digital maps for mission planning, flight video data storage and radio communication functions. An embedded trainer utilizing a dynamic missile simulation with real-time perspective view video for terrain and targets allowed the gunner to practice missile firing missions.

The FOG-M fiber optic data link system is a bidirectional system which utilizes single mode fiber. FIG. 1 illustrates typical components of an airborne missile and FIG. 2 illustrates the ground station of the fiber optic data link system. The downlink portion (i.e. the missile) of the system comprises video sensor 410 which is a TV-type camera sensor mounted on an inertially stabilized platform on missile 400 and generates RS-170 analog video that is indicative of the missile seeker head position and rate. After suitable processing which includes digitally multiplexing, at serial encoder 15, auxiliary data for sensors and telemetry at 1 million bits per second (Mb/s) into the video data, the information from the video is input to first laser transmitter 17 which is a 1330 nanometer (nm) laser transmitter. The first laser transmitter converts the incoming PCM (pulse code modulation) data stream from electrical pulses to optical pulses at a wavelength of 1300 nm. These optical pulses are, then, input to first optical wavelength division multiplexer 14 which is a fused biconical taper three-port optical multiplexer that separates two optical signals by wavelengths. The 1300 nm optical pulses are then passed from transmitter port to common fiber port to be transmitted via single-mode optical fiber 404 at 180 Mb/s to second optical wavelength division multiplexer 24 in ground station 402, depicted in FIG. 2. From the second division multiplexer, the 1300 nm optical pulses are input to second optical receiver 26 whereby they are converted to 180 Mb/s PCM data stream with enclosed pseudo random data scrambling for DC component elimination. This PCM data stream is input to second serial decoder 32 which slices continuously variable input signal into logical one's and zero's for binary processing and converts the composite data stream to parallel video plus 1 Mb/s serial data. D/A (digital-to-analog) converter 34 converts the parallel binary video signals with 8 bits of resolution at a sample rate of 15 million samples per second to produce RS-170 standard analog video at 1 volt peak-to-peak (p-p). The RS-170 standard analog video is input to automatic target tracker 39 which locks on targets in response to the video signal and keeps video sensor 410 directed at the targets and generates tracking errors for guidance of missile 400 to the selected targets. At gunner's station 40, the data from video sensor 410, gunner's commands and the tracker error information is combined to produce low speed serial data stream for missile guidance commands which are then input to third laser transmitter 20 which, in turn, converts the low speed serial data stream to 1 Mb/s optical pulses and uplinks the pulses to first optical receiver 2'5 in missile 400 via second division multiplexer 24, optical fiber 404 and first division multiplexer 14. First optical receiver 25 converts the 1 Mb/s optical pulses to 1 Mb/s serial data stream which is eventually used by missile controller 406 to generate seeker head and fin guidance commands to guide the missile toward a more direct impact on the selected targets. All signal processing and formatting in the FOG-M fiber optic data link system is performed in a single ECL (emitter-coupled logic) gate array. The same array contains both airborne and ground functions and can be utilized in either application by changing an external jumper. This system has 12 channel capability in the ground receiver chassis.

The FOG-M fiber optic data link system has to meet requirements of better than $10^{-9}$ BER (Bit Error Rate) on the downlink and uplink under all conditions. Also, the video SNR (Signal-to-Noise Ratio) is required to be better than 32 dB at 7.5 MHz bandwidth and the optical power margin has to exceed 3 dB. The optical fiber can be no greater than 250 μm in diameter and has to be proof-tested at 200 kpsi. The fiber is precision-wound onto an aluminum bobbin with a stainless steel wire base layer. The fiber is wound with an adhesive to prevent the fiber from pre-maturely paying off the spool and to give the winding pack stability but the adhesive has to be light enough to release the fiber during normal payout over all temperature extremes without breaking the fiber. The fiber bobbin with all associated electro-optics boards and enclosed missile electronics unit boards weighs approximately 6 pounds.

A Brief History of the Dual-Polarized Millimeter Wave Seeker

Examples of dual-polarized millimeter wave seekers in use include W-band and Ka-band seekers that have the capability for dual polarization measurements of targets and backgrounds and providing for high range resolution and cross range sharpening of the sensors' real beam. As depicted in FIG. 3, a typical realization of a dual-polarized high resolution millimeter wave seeker comprises frequency agile source (FAS) 1 that generates the frequencies of the pulses within the transmitted waveform and RF power amplifier 2 that amplifies the pulses generated by the FAS and provides the transmit power. The polarization of the transmit signal can be selected by polarizer 6 on a pulse-to-pulse basis and can be circular, (right-hand or left-hand) or linear (vertical or horizontal).

The transmitted RF energy propagates to the target or background scene that is to be measured. Some portion of the energy reflects from the target or background and some of this reflected energy returns to the seeker sensor where it is received by antenna 7. The received energy is passed through a polarization filter in polarizer 6 where it is separated into orthogonal polarizations such as vertical and horizontal components which, combined with their phase relationship, contain the information of the right and left hand circular polarized (RHCP and LHCP) components of the received RF energy.

Following the polarization filter, the orthogonal polarizations are processed in first and second circulators 41 and 42, respectively. Circulators 41 and 42 route the received RF signal from orthomode transducer (OMT) 5 to mixers 81 and 82, respectively. The mixers accept the RF signal and a signal from the FAS at a frequency of RF plus (or minus) an intermediate frequency reference signal and convert the received signal from a high frequency (the RF) to a lower intermediate frequency (IF). The IF signal maintains the information of the original received millimeter wave signal but, by being at a lower frequency, is easier to process than the millimeter wave signal. The IF can be centered at a frequency of several hundred megahertz to about one gigahertz. The IF bandwidth is usually at least equal to the reciprocal of the transmit pulse width and generally has a bandwidth of several tens of megahertz. First and second intermediate frequency (IF) amplifiers 9 and 10 which are coupled to mixers 82 and 81, respectively, provide low pass filtering to select the IF component from the mixer output and amplify the selected IF component. The amplified IF signal, still containing amplitude and phase information of the received millimeter wave signal, is input to first and second In-phase and Quadrature (I and Q) detectors 12 and 13, respectively, which reduce the frequency of the measured data to the basic information content while maintaining knowledge of the amplitude and phase relationships of the data. At this point, the data can be sampled at a rate equal to the pulse repetition frequency (PRF) of the transmitted waveform. These data samples are then passed to a frequency analysis section, first and second Fast Fourier Transforms (FFT) 36 and 37, respectively, which provide a frequency analysis of the data samples to produce the high range resolution profiles and target doppler. Discriminant processor 38, then, processes and analyzes the data to perform the desired sensor functions which can include target detection, discrimination, classification and, perhaps, identification.

The received orthogonal polarizations are usually denoted by special nomenclature which relate them to the transmit polarization. In the case of circular transmit polarization, the same sense receive polarization is called the Even polarization signal while the opposite sense receive signal is called the Odd polarization signal. In the case of linear transmit polarization, the same sense receive polarization signal is called the Co-polarized signal while the orthogonal receive polarization signal is called the Cross-polarized signal. The same antenna can be used to provide both the transmit and receive operations.

Use of the millimeter wave seeker allows the polarization characteristics of a reflecting surface (vehicle, background, building, bridge, etc.) to be measured and provides for some identification of surface type based upon its polarization characteristics. For example, most natural backgrounds (such as open fields, woods and water) tend to provide more odd than even reflected energy. In comparison, snow, which is refrozen or very dry with no surface water, reflects about as much odd energy as even energy. Complex armored targets also reflect even and odd energy in about equal proportions. Buildings with flat surfaces would be expected to reflect more single bounce or odd energy than two-bounce or even energy.

Another capability provided by the advanced millimeter wave seeker is the ability to separate or resolve the surface being measured into very fine range cells. The range resolution is determined by the frequency deviation or bandwidth of the transmitted signal and can be calculated as Range Resolution=Speed of Light/2 X Transmit Bandwidth For example, for a transmit bandwidth of 1 GHz the range resolution will be 0.15 meters or about one-half foot.

In the millimeter wave seeker, this resolution capability is usually implemented by transmitting a stepped or swept frequency waveform and sampling the return signals at each frequency interval or at the rate of the transmitted pulses. The samples are then subjected to a frequency analysis which is easily accomplished by a Fast Fourier Transform (FFT). For a coherent sensor (where phase relationship between the transmit and receive signals is known) the FFT will provide a true range profile. If the phase relationship is not preserved, as in a non-coherent sensor implementation, the FFT will provide the autocorrelation of the true range profile: in other words, a profile that represents the separation between pairs of individual scatterers within the reflecting surface.

Yet a third feature of the state-of-the-art millimeter wave seeker is Doppler beam sharpening (DBS). This feature is basically a version of the classical synthetic aperture radar (SAR) and uses the Doppler frequency spread across the antenna beam to improve the sensor cross range resolution over that which is provided by the real beam resolution. Doppler beam sharpening, as referred to here, means that the antenna beam can be scanned to cover a wider surveillance area than could be achieved with a fixed beam. Therefore, the prior art in millimeter wave seekers has provided sensors/seekers which have the capabilities to measure polarization characteristics of reflecting surfaces and to separate these surfaces into resolution cells which are small in range and in cross range. These capabilities yield the information necessary to investigate the polarization characteristics of the surface or a collection of surfaces under scrutiny. The millimeter wave capability to penetrate weather (clouds and rain) and particulates (smoke and dust) enables effective measurements in nearly all environmental conditions. There is much data to be reduced and analyzed and actheving this in a small dispensable air vehicle such as a missile tends to be difficult and expensive. The applicants' invention provides a way to accomplish the data reduction and analysis on the ground where implementation is easier and data processing equipment is not destroyed concurrently with the missile impact on the selected target.

SUMMARY OF THE INVENTION

In applicants' invention, the millimeter wave data may be transferred at the IF frequency from missile 400 to ground station 402 in which case, two optical channels (each channel comprised of a circulator, mixer and IF amplifier) are required to maintain the separation of orthogonal polarizations. This is illustrated in FIGS. 4 and 5. The millimeter wave data can be centered at a frequency of 200–300 MHz or can be at a frequency of 1 GHz . The signal bandwidth will be on the order of 30–50 MHz. The main advantage of this approach is that the final detector circuitry comprised of first and second I and Q detectors 12 and 13, the analog-to-digital (A/D) converter, the FFT circuits and the discrimination network are all placed on the ground station where they avoid destruction concurrent with the missile impact on the targets.

An alternate approach, illustrated in FIGS. 6 and 7, is to transfer the wave data following the analog-to-digital conversion. Here, the frequency of the data will be lower (roughly equal to the sensor pulse repetition frequency, 100 KHz or so) and four channels of data (Odd I&Q and Even I&Q) will be required. This approach places a lesser requirement on the data link and thus can result in a less expensive link. Disadvantages are that the I and Q detectors and the analog-to-digital circuits remain on the missile. Still the FFT circuits and the discrimination network are transferred to the ground station.

There are several schemes that may be utilized for multiplexing the millimeter wave data with the infrared data from infrared sensor 43 for transmission from the missile to the ground station using wavelength or time division multiplexing or combinations of these. One approach depicted in FIG. 4, is to use the millimeter data in analog form centered at 200–300 MHz to modulate second laser transmitter 16, fourth laser transmitter 18 and fifth laser transmitter 19 on the missile operating at wavelengths of say 1540 nm, 1545 mn and 1550 nm, respectively, to provide a dense wavelength division multiplexing scheme with five links: one for each millimeter polarization, one for IF reference, one for the infrared imagery and one uplink.

Transmission at IF to the ground station is the preferred choice because it minimizes the quantity of equipment on the missile.

DESCRIPTION OF THE PREFERRED EMBODIMENT

Figure 1:
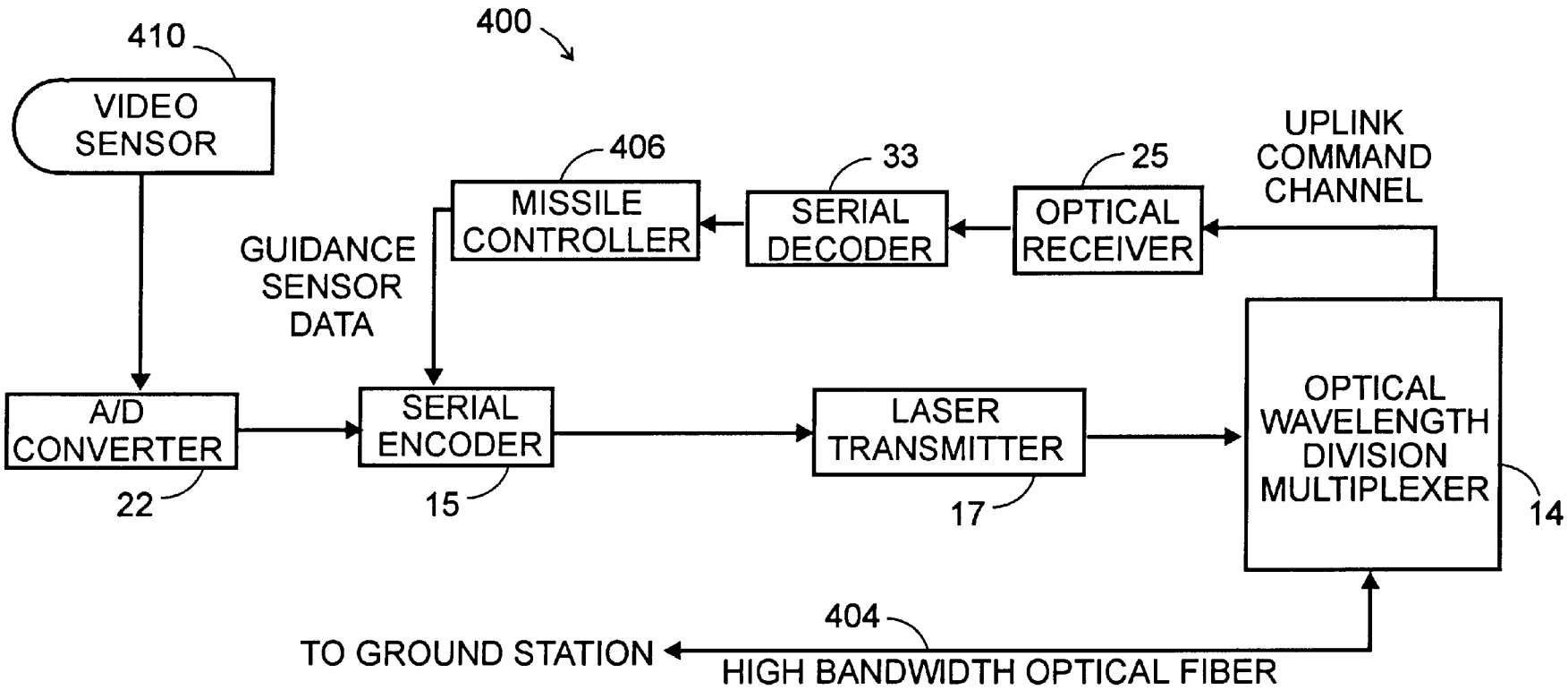
FIG. 1 shows typical components of an airborne missile.
Figure 2:
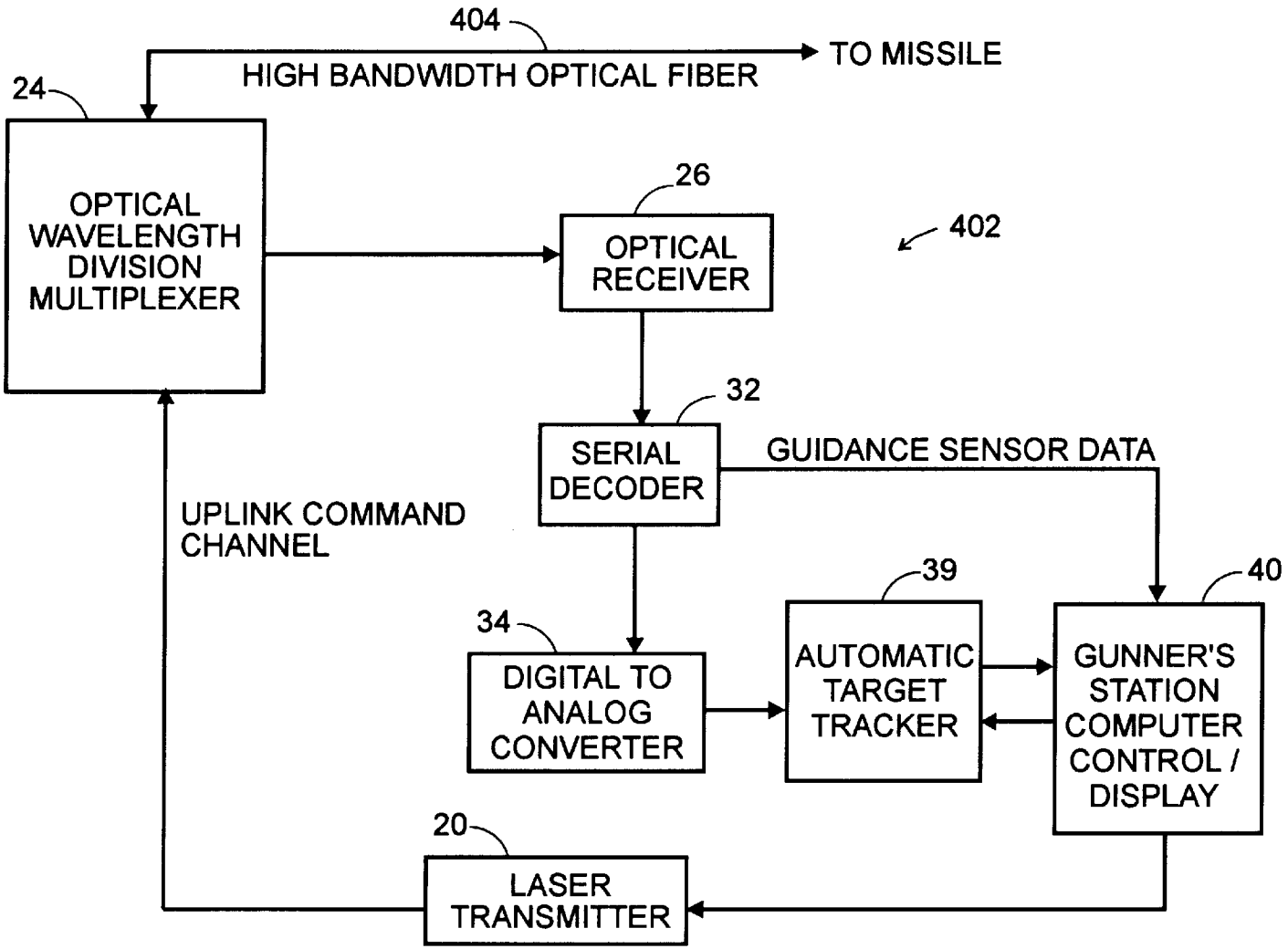
FIG. 2 shows ground station of a fiber optic data link in a missile system such as FOG-M.
Figure 3:
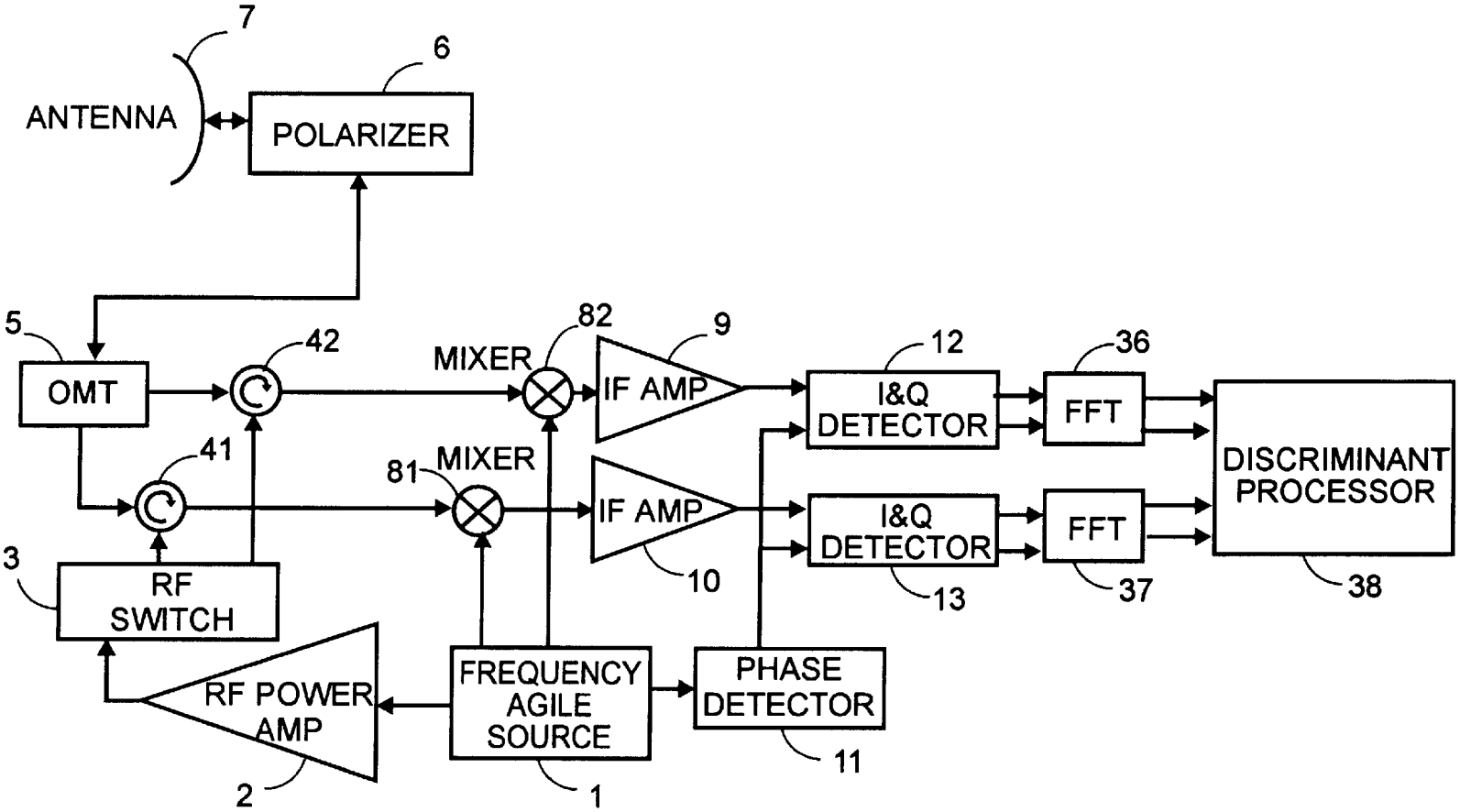
FIG. 3 illustrates a typical realization of a dual polarized high resolution millimeter wave seeker.

Referring now to the drawing which is illustrative only without being limiting and wherein like numbers represent like parts that perform like functions in each of the several figures and arrows indicate the direction of signal travel and broken lines encase the inventive portions, two alternate embodiments of the applicants' invention are presented.

Preferred embodiment of applicants' invention

Figure 4:
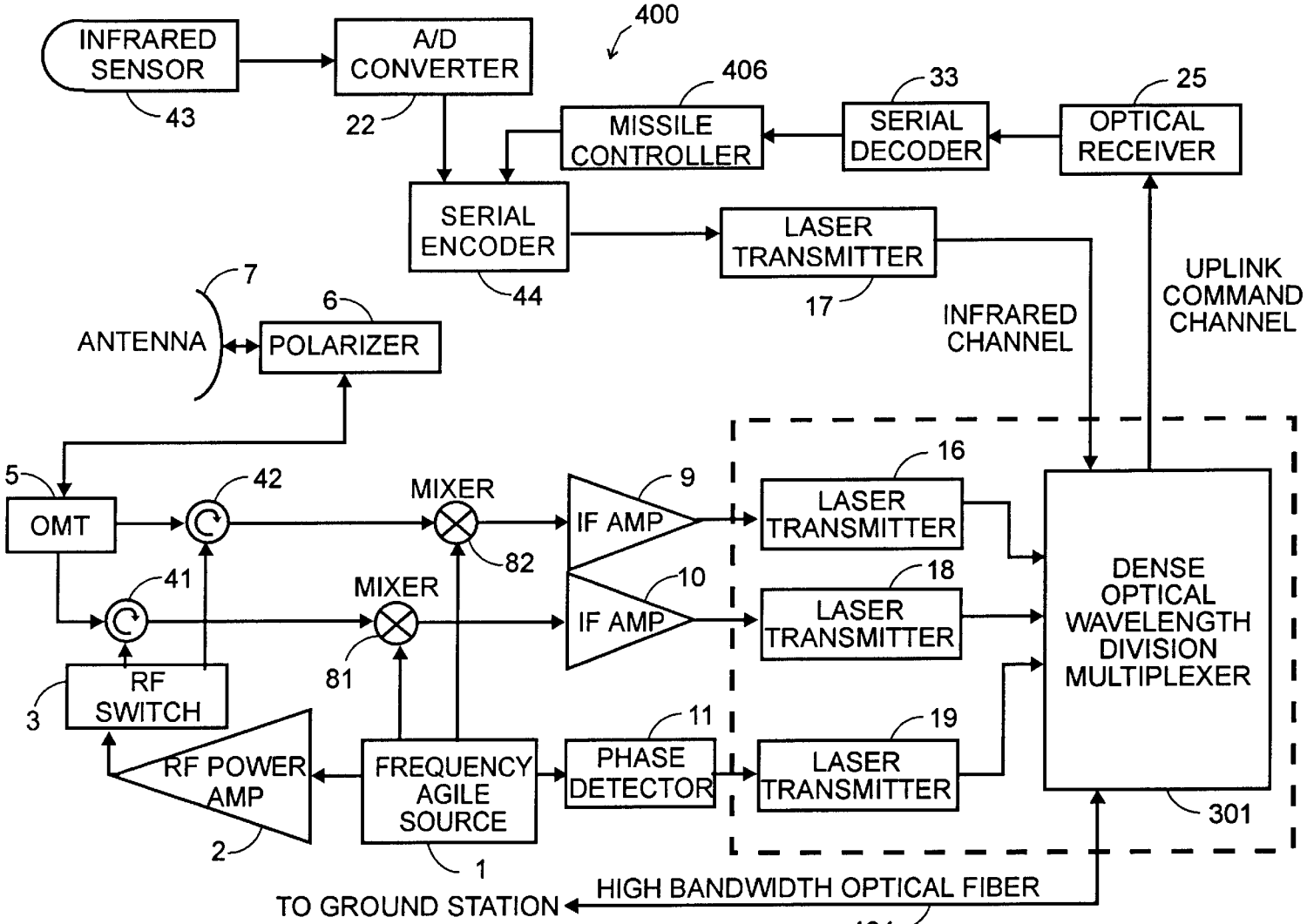
FIGS. 4 and 5 depict a preferred embodiment of a dual band millimeter-infrared data link.
Figure 5:
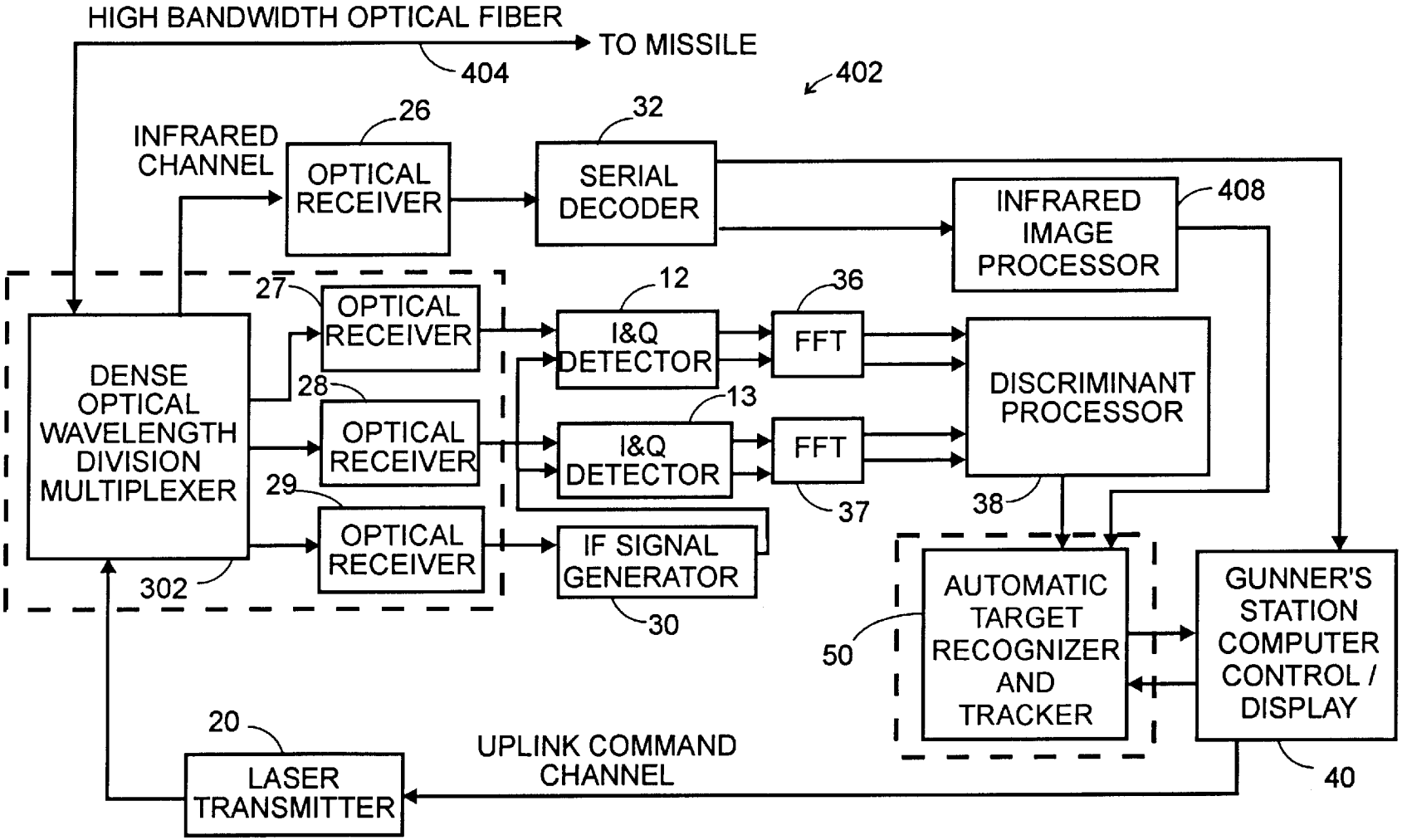

The preferred embodiment of the dual band millimeter-infrared fiber optics guidance data link is illustrated in FIGS. 4 and 5. In missile 400, the inventive portion includes first dense optical wavelength division multiplexer 301 and second and fourth laser transmitters 16, 18 that are coupled between the first dense multiplexer and first IF amplifier 9 and second IF amplifier 10, respectively, and fifth laser transmitter 19 that is coupled between the first dense multiplexer and phase detector 11. Laser transmitters 16 and 18 which are single-node solid state lasers operating at 1540 nm and 1545 mn, respectively, receive from IF channels (amplifiers) 9 and 10 the amplified IF signals (center frequency: 300 megahertz) containing amplitude and phase information of the signals received by antenna 7 and convert them to optical pulses at 1540 nm and 1545 nm. Laser transmitter 19 receives from phase detector 11 amplified IF signal containing amplitude and phase information of the IF reference signal and converts the signal to optical pulses at 1550 nm. The optical pulse outputs of laser transmitters 16, 18 and 19, along with optical pulse output at 1555 nm of first laser transmitter 17 are input to first dense optical wavelength division multiplexer 301 (five-port) which separates the multiple-wavelength optical pulses by wavelengths, passing the 1540 nm-1555 nm optical pulses from transmitter ports to common fiber port. These pulses are, then, downlinked via optical fiber 404 to ground station 402 wherein the inventive portion includes second dense optical wavelength division multiplexer 302 and third and fourth optical receivers 27 and 28 that are coupled between the second dense multiplexer (five-port) and first and second I and Q detectors 12 and 13, respectively, and fifth optical receiver 29 coupled between the second dense multiplexer and IF signal generator 30. The second dense multiplexer, just like the first dense multiplexer, is capable of combining optical pulses with wavelengths as close as 3.2 nanometers with adequate isolation for signal separation. The second dense multiplexer separates by wavelengths the multiple-wavelength optical pulses that are modulated with the IF information from the vertical and horizontal channels and the IF phase reference and inputs the pulses to optical receivers 27, 28 and 29 which convert the optical pulses to the IF signal at 300 megahertz and the IF phase reference. IF signal generator 30 generates an IF signal which is a replica of the IF signal of the missile and inputs this IF signal to I and Q detectors 12 and 13. In the I and Q detectors, the in-phase and quadrature signals are recovered. Subsequently, Fast Fourier Transforms for each of the two polarization signals are obtained to provide the feature vectors that can be used to discriminate targets from clutter.

Automatic target recognizer and tracker 50, a part of the inventive portion, recognizes a pre-selected target and tracks its movement and position and inputs the data to gunner's station 40 where missile guidance commands are generated. These commands are uplinked in the form of optical pulses of 1535 nm at 1 Mb/s from second dense multiplexer 302 via optical fiber 404 to first dense multiplexer 301 to be further processed by the missile and ultimately used to guide the missile for more direct impact on the selected target.

This embodiment, while placing greater demands on optical fiber 404 in terms of data rates, offers the approach that removes the most complex equipment from the missile to the ground station and is, therefore, the preferred embodiment.

Alternate embodiment of applicants' invention

Figure 6:
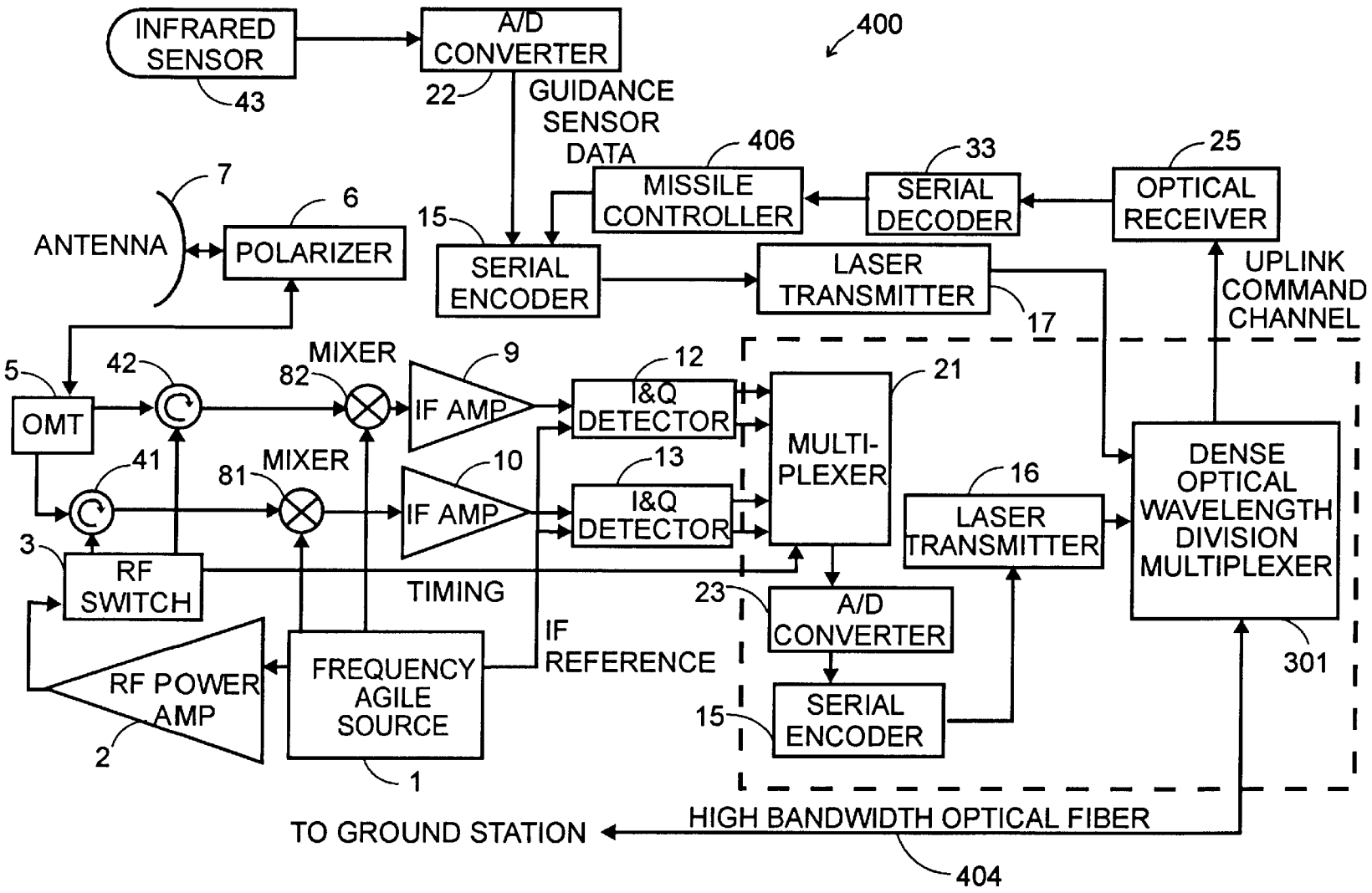
FIGS. 6 and 7 show an alternate embodiment of a dual band millimeter-infrared data link.
Figure 7:
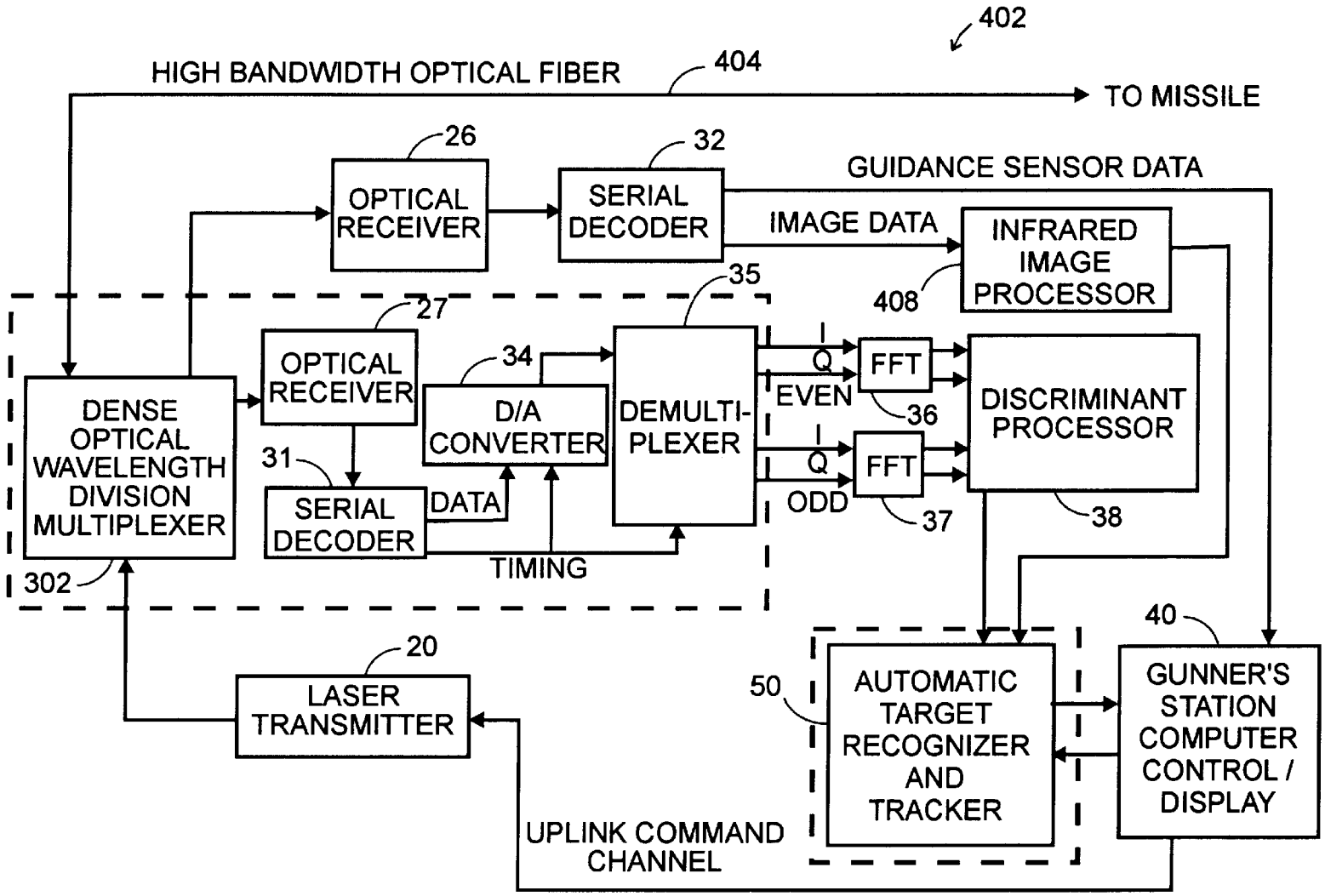

An alternate embodiment, depicted in FIGS. 6 and 7, features a dial-amplifier millimeter seeker front end that is functionally identical with that discussed above in the section titled "A Brief History of the Dual-Polarized Millimeter Wave Seeker" through the intermediate frequency stages. The output of these two stages are applied as modulation to optical sources operating at the same wavelength in the low attenuation region for optical fibers. The operational sequence is as follows: The transmitter emits two pulses with RHC or LHC polarization. The pulses of energy are reflected from the target and components of IUC and LHC polarizations are received by first and second IF amplifiers 9 and 10. A clock, illustrated as "timing" in FIG. 7, synchronizes the emission and reception of the two pulses with multiplexer 21 on the missile and demultiplexer 35 on the ground station so that the modulated signal on the RHC channel is sampled on the first pulse and the LHC channel on the second pulse. The polarization of the antenna can, then, be switched to the orthogonal polarization and two pulses emitted at that polarization. Reflected energy is again received on both channels (amplifiers), and the synchronizations of the multiplexer/demultiplexer pair again allows the RHC channel to be sampled on the first pulse and the LHC channel to be sampled on the second pulse. The entire sequence of four pulses, as described above, allows an approximation to the scattering matrix of the target to be recovered after detection in the ground station. The phase between the outputs of the two IF channels is preserved after transmission over optical fiber 404 and can be recovered in the ground station. From IF amplifiers 9 and 10, the amplified signals are input to I and Q detectors 12 and 13. The I and Q detectors demodulate the IF signals to recover the in-phase and quadrature signals which collectively contain the information (baseband information) of the input IF signal. The in-phase and quadrature signals are then input to multiplexer 21 which produces a single electrical data stream consisting of an analog-sampled, time-multiplexed series. This electrical data stream, then, goes to second analog-to-digital converter 23 which samples the baseband data at the rate of the radar pulse repetition frequency (PRF) of 50 kilohertz, thereby producing four channels of digital data (the I and Q for the RHC and LHC radar) at the PRF. Serial encoder 15 converts the four input data streams to a single serial data stream containing the I and Q for the RHC and LHC channels. The output of the serial encoder is input to second laser transmitter 16 which converts the serial data stream to optical pulses of 1545 nm. As in the above-described preferred embodiment, first dense optical wavelength division multiplexer 301 separates multiple-wavelength optical signals by wavelengths and transmits 1540–1550 nm optical pulses, via optical fiber 404, to second dense optical wavelength division multiplexer 302 located in the ground station. From the second dense multiplexer, the optical pulses travel to third optical receiver 27, whereby the optical pulses are converted to emitter coupled logic (ECL) serial data stream and input to first serial decoder 31. The first serial decoder converts the ECL serial data to produce parallel digital data samples of the I and Q even and odd signals. These digital samples of the I and Q components of the RHC and LHC channels are converted by digital-to-analog converter 34 to baseband analog data at the rate of the radar PRF. The baseband data is, in turn, converted by demultiplexer 35 into even and odd I and Q analog signals at the appropriate times in response to timing signals received by the demultiplexer from serial decoder 31. The even and odd I and Q analog signals are input to first and second Fast Fourier Transforms 36 and 37 which perform the fast Fourier transforms of the input signals to obtain the target discriminants. Missile guidance information is uplinked in a manner similar to that described for preferred embodiment above.

A dual-band seeker concept for LONGFOG missile does not offer significant advantages unless both the infrared and millimeter bands are processed in the ground station. One advantage is the same as one for the single band LONGFOG: much of the electronics for signal processing can be moved from the missile to the ground station where more sophisticated resources can be brought to bear on the task. Additional advantages are offered by the availability of the millimeter data in the ground station in that the millimeter data allows the ground controller to correlate the two data sets, thus improving the reliability of such functions as combat identification.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. In a dual band missile guidance system that consists of a missile flying toward a target, a ground station for providing the guidance information and a high bandwidth optical fiber for providing bi-directional communication between the missile and the ground station, wherein THE MISSILE contains a millimeter wave sensor; an infrared sensor; a plurality of circulators; a frequency agile source for generating radio frequency (RF) stepped signal, an intermediate frequency reference signal having a pre-selected center frequency and bandwidth, and a combination of the RF stepped and intermediate frequency reference signals; at least two mixers coupled simultaneously to the circulators and the frequency agile source and being capable of converting any received RF signal to a lower intermediate frequency signal; a phase detector coupled to the frequency agile source for detecting and outputting the phase of the intermediate frequency reference signal; a first intermediate frequency amplifier and a second intermediate frequency amplifier, the amplifiers being coupled to the mixers for providing low pass filtering to isolate the intermediate frequency signal from the mixer output and amplify the isolated signal; a first laser transmitter for converting electrical signals to optical pulses; a first optical receiver for converting optical pulses to electrical signals; wherein THE GROUND STATION contains a second optical receiver for converting optical pulses to electrical signals and a gunner's station for generating missile guidance information; wherein THE GUIDANCE SYSTEM further contains a first and a second in-phase and quadrature (I and Q) detectors, the I and Q detectors demodulating any received intermediate frequency signals to recover therefrom the baseband information of amplitude and phase; a plurality of fast Fourier transforms coupled to the I and Q detectors for receiving therefrom the baseband information and analyzing the baseband information to produce target motion information; a discriminate processor and an automatic target tracker; wherein the I and Q detectors, fast Fourier transforms, the discriminate processor and the tracker may be placed either on the missile or on the ground station; AN IMPROVEMENT for transferring the target radar data at the intermediate frequency level to the ground station and enabling the placement of the I and Q detectors, fast Fourier transforms, discriminate processor and target tracker on the ground station so as to avoid their destruction concurrent with missile impact on the target, SAID IMPROVEMENT comprising: an air-borne placement enabler located on the missile, said air-borne placement enabler being coupled simultaneously to the intermediate frequency amplifiers and the phase detector, said air-borne enabler receiving amplified intermediate frequency signals from the amplifiers and the phase of the intermediate frequency reference signal from the phase detector and converting the amplified signals to optical pulses and separating said optical pulses by differing wavelengths; a ground-borne placement enabler located on the ground station, said ground-borne placement enabler being coupled simultaneously to the I and Q detectors and the second optical receiver, said ground-borne placement enabler receiving said optical pulses via the optical fiber from said air-borne placement enabler and further processing the optical pulses to produce therefrom the intermediate frequency signal and the intermediate frequency reference signal and inputting both said signals to the I and Q detectors, said ground-borne placement enabler being further coupled to the gunner's station control to receive from the gunner's station the missile guidance information, the guidance information being transmitted to said air-borne placement enabler through the optical fiber to guide the missile more directly toward the target.

2. An improvement for enabling the placement of the I and Q detectors, fast Fourier transforms, discriminate processor and target tracker on the ground station as set forth in claim 1, wherein said air-borne placement enabler comprises a first dense optical wavelength division multiplexer having a first common port, a first transmitter port and a first receiver port, said first dense multiplexer being coupled simultaneously to said first optical receiver and the optical fiber; a second laser transmitter and a fourth laser transmitter, said second and fourth transmitters being coupled between the intermediate frequency amplifiers and said first dense multiplexer, said second and fourth transmitters receiving amplified intermediate frequency signals from the amplifiers and converting the signals to optical pulses and transmitting said pulses to said first dense multiplexer, said first dense multiplexer separating said optical pulses by wavelengths and disposing said pulses to said various ports.

3. An improvement as set forth in claim 2, wherein said second and fourth laser transmitters are coupled to the first and second intermediate frequency amplifiers, respectively.

4. An improvement as set forth in claim 3, wherein said air-borne placement enabler further comprises a fifth laser transmitter coupled between the phase detector and said first dense multiplexer, said fifth transmitter receiving the phase of the intermediate frequency reference signal from the phase detector and transmitting the phase to said first dense multiplexer.

5. An improvement as set forth in claim 4, wherein said second, fourth and fifth laser transmitters are single mode solid state lasers and transmit optical pulses at 1540 nanometers, 1545 nanometers and 1550 nanometers, respectively, to said first dense multiplexer.

6. An improvement as set forth in claim 5, wherein said first dense multiplexer is further coupled to the first laser transmitter and receives therefrom optical pulses at 1555 nanometers on single mode fiber, said dense multiplexer passing 1540–1555 nanometers optical pulses from transmitter ports to a common fiber port.

7. An improvement as set forth in claim 6, wherein said ground-borne placement enabler comprises: a second dense optical wavelength division multiplexer coupled between the optical fiber and the gunner's station, said gunner's station producing a low speed serial data stream indicative of the missile guidance information, said second dense multiplexer having a second common port, a second transmitter port and a second receiver port, said second dense multiplexer receiving said optical pulses from said first dense multiplexer via the optical fiber; an intermediate frequency signal generator for generating an intermediate frequency signal that replicates the intermediate frequency signal generated by the frequency agile source on the missile; a plurality of optical receivers coupled between said second dense multiplexer, the I and Q detectors and said intermediate frequency signal generator, said optical receivers being capable of converting optical pulses to the intermediate frequency signal at the pre-selected center frequency and intermediate frequency phase reference, said optical receivers inputting said converted signal to the I and Q detectors and said intermediate frequency signal generator.

8. An improvement as set forth in claim 7, wherein the ground station further contains a third laser transmitter coupled between the gunner's station and said second dense multiplexer, the third laser transmitter receiving the serial data stream from the gunner's station and converting the data stream to optical pulses and transmitting the pulses to said second dense multiplexer, said second dense multiplexer further transmitting the pulses to said air-borne placement enabler via the optical fiber and said air-borne placement enabler transmitting the pulses to the first optical receiver to be used subsequently in directing the missile more toward the target.

9. An improvement as set forth in claim 8, wherein the center frequency of the intermediate frequency signal is 300 megahertz and the bandwidth is 6 megahertz.

10. In a dual band missile guidance system that consists of a missile flying toward a target, a ground station for providing the guidance information and a high bandwidth optical fiber for providing bi-directional communication between the missile and the ground station, wherein THE MISSILE contains a millimeter wave sensor; an infrared sensor; a first analog-to-digital (A/D) converter; at least two mixers; a first intermediate frequency amplifier and a second intermediate frequency amplifier, the amplifiers being coupled to the mixers for providing low pass filtering to isolate the intermediate frequency signal from the mixer output and amplify the isolated signal; a frequency agile source coupled to the mixers, the source generating a radio frequency (RF) stepped signal, an intermediate frequency reference signal having a pre-selected center frequency and bandwidth, and a combination of the RF stepped frequency and intermediate frequency reference signals; a plurality of in-phase and quadrature (I and Q) detectors coupled simultaneously to the frequency agile source and the amplifiers, the I and Q detectors receiving the amplified intermediate frequency signal and intermediate frequency reference signal from the amplifiers and the frequency agile source, respectively, and demodulating the signals to recover in-phase and quadrature (I and Q) signals containing therein the baseband information; a first laser transmitter for converting electrical signals to optical pulses; a first optical receiver for converting optical pulses to electrical signals; wherein THE GROUND STATION contains a second optical receiver for converting optical pulses to electrical signals and a gunner's station for generating missile guidance information; wherein THE GUIDANCE SYSTEM further contains a plurality of fast Fourier transforms; a discriminate processor and an automatic target tracker; wherein the fast Fourier transforms, the discriminate processor and the tracker may be placed either on the missile or on the ground station; AN IMPROVEMENT enabling the placement of the fast Fourier transforms, discriminate processor and target tracker on the ground station so as to avoid their destruction concurrent with missile impact on the target, SAID IMPROVEMENT comprising: an air-borne placement enabler.

11. An improvement for enabling the placement of the fast Fourier transforms, discriminate processor and target tracker on the ground station as set forth in claim 10, wherein said air-borne enabler comprises a first dense optical wavelength division multiplexer having a first common port, first transmitter ports and a first receiver port, said first dense multiplexer being coupled simultaneously to the first optical receiver and the optical fiber; a second analog-to-digital (A/D) converter; a multiplexer coupled between the I and detectors and said second A/D converter, to receive from the I and Q detectors the I and Q intermediate frequency signals and selectively switch between the I and Q intermediate frequency signals so as to feed the appropriate signal to said second A/D converter, said second A/D converter sampling the baseband data at a pre-selected rate; a serial encoder coupled to said second A/D converter for converting incoming data streams to a single serial data stream; and a second laser transmitter coupled between said serial encoder and said first dense multiplexer, said second transmitter receiving said single serial electrical data stream from said serial encoder and converting said serial data stream into optical pulses, said optical pulses being input to said first dense multiplexer whereby said optical pulses are separated by differing wavelengths and disposing of into various ports.

12. An improvement as set forth in claim 11, wherein said second laser transmitter is a single mode solid state laser and transmits optical pulses at 1545 nanometers.

13. An improvement as set forth in claim 12, wherein said first dense multiplexer is further coupled to the first laser transmitter and receives therefrom optical pulses at 1550 nanometers on single mode fiber, said dense multiplexer passing 1545–1550 nanometers optical pulses from the transmitter ports to the common port.

14. An improvement as set forth in claim 13, wherein said ground-borne enabler comprises: a second dense optical wavelength division multiplexer coupled between the optical fiber and the gunner's station, said second dense multiplexer having a second common port, second transmitter ports and a second receiver port, said second dense multiplexer receiving said optical pulses from said first dense multiplexer via the optical fiber; a serial decoder producing timing signals; a third optical receiver coupled between said second dense multiplexer and said serial decoder, said third optical receiver receiving said optical pulses from said second dense multiplexer and converting said optical pulses to emitter coupled logic (ECL) serial digital data stream and inputting said serial digital data stream to said serial decoder, said serial decoder converting said ECL serial digital data stream to parallel transistor-transistor logic (TTL) samples; a digital-to-analog (D/A) converter coupled to said serial decoder to receive therefrom said parallel TTL samples and convert said samples to baseband analog data at the rate of a pre-selected radar pulse repetition frequency; a demultiplexer coupled simultaneously to said D/A converter, said serial decoder and the fast Fourier transforms, said demultiplexer receiving said baseband analog data and converting said baseband analog data into even and odd baseband I and Q analog signals in response to said timing signals received from said serial decoder, said demultiplexer transmitting said even and odd baseband I and Q analog signals to the fast Fourier transforms.

15. An improvement as set forth in claim 14, wherein the ground station further contains a third laser transmitter coupled between the gunner's station and said second dense multiplexer, the gunner's station producing a low speed serial data stream indicative of the missile guidance information, and the third laser transmitter receiving the serial data stream from the gunner's station and converting the data stream to optical pulses and transmitting the pulses to said second dense multiplexer, said second dense multiplexer further transmitting the pulses to said air-borne placement enabler via the fiber and said air-borne enabler transmitting the pulses to said first optical receiver for further processing for ultimate use in directing the missile more toward the target.

* * * * *